US006293066B1

(12) United States Patent
Lohrey

(10) Patent No.: US 6,293,066 B1
(45) Date of Patent: Sep. 25, 2001

(54) EXPANSION JOINT GUIDE FOR MASONRY WALLS

(76) Inventor: George A. Lohrey, 7005 W. County Rd. 850N., Middletown, IN (US) 47356

( * ) Notice: Subject to any disclaimer, the term of this patent is extended or adjusted under 35 U.S.C. 154(b) by 0 days.

(21) Appl. No.: 09/227,973

(22) Filed: Jan. 8, 1999

Related U.S. Application Data

(60) Provisional application No. 60/070,961, filed on Jan. 9, 1998.

(51) Int. Cl.[7] ..... E04B 1/38

(52) U.S. Cl. ..... 52/396.08; 52/393; 52/396.04; 52/402; 52/747.12; 52/745.09

(58) Field of Search ..... 52/393, 395, 396.04, 52/396.08, 396.02, 402, 741.4, 742.1, 742.14, 742.16, 747.12, 745.09, 745.05

(56) References Cited

U.S. PATENT DOCUMENTS

| | | |
|---|---|---|
| 2,016,968 | 10/1935 | Marble . |
| 2,085,168 | 6/1937 | Payne . |
| 2,239,127 | 4/1941 | Swenson . |
| 2,361,205 | 10/1944 | Hoover . |
| 2,869,356 | 1/1959 | Kulhavy et al. . |
| 3,099,110 | 7/1963 | Spaight . |
| 3,137,973 | 6/1964 | Williams . |
| 3,508,369 | 4/1970 | Tennison . |
| 3,760,544 | 9/1973 | Hawes et al. . |
| 5,168,683 | 12/1992 | Sansom et al. . |
| 5,263,294 | 11/1993 | Koenig et al. . |

*Primary Examiner*—Christopher T. Kent
*Assistant Examiner*—Jennifer I. Thissell
(74) *Attorney, Agent, or Firm*—Woodard, Emhardt, Naughton, Moriarty & McNett

(57) ABSTRACT

Disclosed is an expansion joint guide for constructing a multi-course masonry block wall. The guide has an elongated flat planar base of a rigid material and an elongated planar leg the length of which is less than the thickness of the blocks of the wall to be constructed and the thickness of which is the desired thickness of the joint between laterally adjacent blocks of the wall. The leg extending substantially perpendicular to the base to serve as a locator for the masonry blocks forming the sections of the wall on either side of the guide and means preferably in the form of fasteners or adhesives are used to secure the base to an underlying wall.

8 Claims, 1 Drawing Sheet

EXPANSION JOINT GUIDE FOR MASONRY WALLS

This application claims priority from provisional application Ser. No. 60,070,961 filed Jan. 9, 1998. The invention relates to an expansion joint guide for providing an improved expansion joint for assuring that multi-course concrete block, brick, stone and the like walls (hereinafter referred to as masonry walls) may expand and contract under changing environmental conditions and uneven settling. The invention also relates to a method of constructing a multi-course masonry wall utilizing said guide.

BACKGROUND OF THE INVENTION

There is a recognized problem with cracking of masonry walls due to the expansion and contraction of the walls and the uneven settling of the footings. Various methods have been tried for solving this problem. Also, there is a need for an improved guide for assuring that the wall joints are plumb and for finishing wall edges. Current practice in this regard utilizes a short length of wooden or metal bar which is moved vertically along the wall edge to simply provide a guide for finishing the wall edge after which it is removed. This prior art practice is time consuming and leads to jagged control joint edges.

Some of the past practices in attempting to prevent cracking of masonry walls have included horizontal and vertical reinforcements in the mortar, a practice which has not been very effective. Other approaches have utilized resilient members between rows of blocks. Such a suggestion is found in U.S. Pat. No. 2,869,356 and U.S. Pat. No. 3,099,110. The resilient members in these patents are cruciform in shape to inter fit with grooves in the masonry blocks. Another attempt has been through the utilization of asphalt impregnated horizontal sheets which are used in lieu of mortar and may be nailed to an interior sheet of wall board. Such a method is shown in U.S. Pat. No. 2,239,127.

Other prior art suggestions in combating cracking caused by expansion contraction and uneven settling of footings has utilized rubber sealing joints and caps. These have been suggested in U.S. Pat. No. 3,508,369; U.S. Pat. No. 2,016,968; U.S. Pat. No. 3,760,544; and U.S. Pat. No. 5,168,683.

SUMMARY OF THE INVENTION

In accordance with one embodiment of the invention, a guide is provided for aligning the masonry blocks of a multi-course masonry block wall and for providing an improved expansion joint for that wall. The guide has a rigid elongated flat planar base which is adapted to be secured to a flat surface such as an underlying wall which may be constructed, for example, of wall board or sheet rock, concrete or concrete block. The guide also has a rigid elongated planar leg which is integral and longitudinally co-extensive with the base and extends substantially perpendicular from the base. This perpendicular extension of the leg is substantially less than the thickness (i.e., front to back) of bricks or other masonry blocks of the wall, and the leg is of a thickness substantially equal to the desired thickness of the joint to be formed between adjacent sections of the wall. The distal or outer end portion of the leg is preferably longitudinally slotted in the portion extending between the masonry blocks to provide a transverse resilience at this outer end. Thus, the base of the guide may be secured to a support structure (such as an underlying wall), with a planar leg extending outwardly and defining a vertical joint between the sections of the wall to be constructed.

The invention includes the process for the construction of a multi-course masonry wall having a vertical expansion joint between adjacent sections of the wall, with the wall covering a previously constructed underlying wall. That process includes the steps of providing a guide having an elongated flat planar base and elongated planar leg extending substantially perpendicularly outward from the base. The width of the leg is preferably less than the thickness of the wall to be constructed, and the thickness of the leg is equal to the desired thickness of the joint between laterally adjacent blocks of the wall being constructed. The process further includes the step of securing the base of the guide to the previously constructed underlying wall with the leg of the guide extending vertically and located at the desired position of the vertical expansion joint between adjacent sections of the wall being constructed. The construction of the masonry wall is then completed using the leg of the guide to position the edges of the masonry blocks at the vertical expansion joint in the wall.

DETAILED DESCRIPTION OF THE PREFERRED EMBODIMENT

Figure 1:
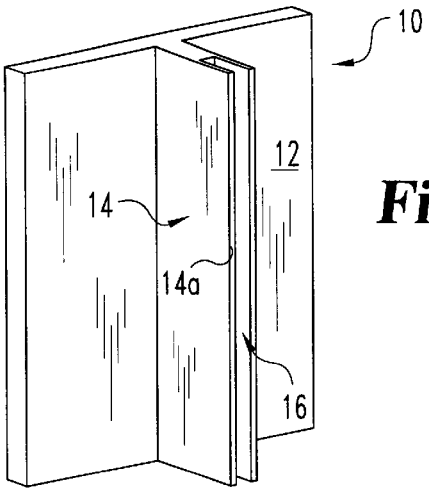
FIG. 1 is a perspective view of an expansion joint guide constructed substantially in accordance with this invention.

FIG. 1 shows a guide 10 constructed in accordance with one embodiment of this invention. This guide 10 includes an elongated flat planar base 12 and an elongated planar leg 14 which is longitudinal co-extensive with the base and is preferably integral with the base 12. The guide 10 is preferably an extruded shape of a rigid material such as, for example, styrene, or it may be formed of any of a number of well known rigid plastic materials. The leg 14 of the guide extends substantially perpendicularly from the base 12 a distance which is substantially less than the thickness of the blocks of the wall to be constructed utilizing the guide. The thickness of the guide is equal to the desired thickness of the spacing between adjacent blocks of the wall to be constructed, i.e., the thickness of the joint between the adjacent sections of the wall. The distal or outer end of the leg 14 preferably has a longitudinal slot 16, which in this embodiment is in the entire portion of the leg which extends between the adjacent blocks of the wall to be constructed to provide some transverse resilience and allow for expansion and contraction.

Figure 2:
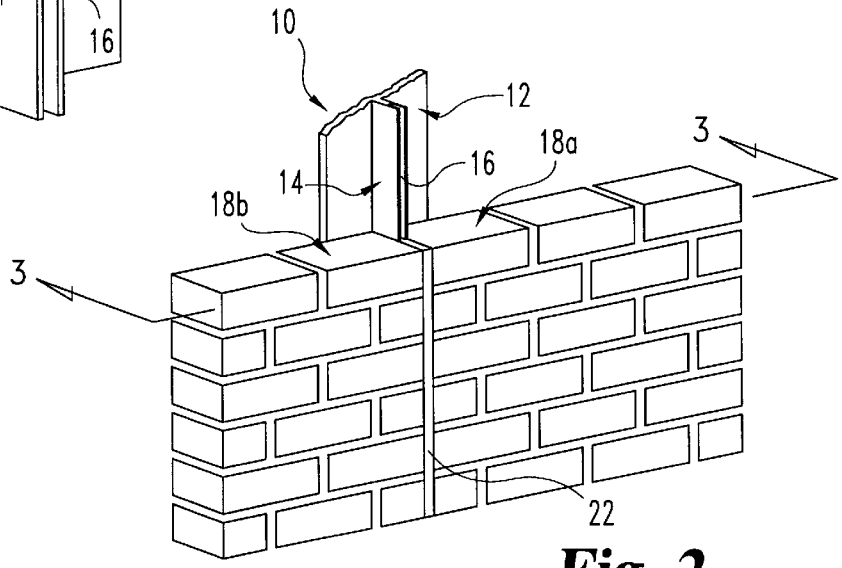
FIG. 2 is a perspective view of a multi-course masonry wall in which the expansion joint guide of this invention is utilized in the construction thereof.

In FIG. 2 the guide 10 is shown being utilized in the construction of a multi-course masonry block wall 18. The guide may be used, for example, in the construction of brick walls, concrete block walls or stone walls to provide a vertical expansion joint between adjacent sections 18*a* and 18*b* of the wall. The guide 10 is preferably attached to an underlying support structure such as a wallboard or sheet rock 20 which serves as the support or underlying wall to be covered by the masonry wall.

Figure 3:
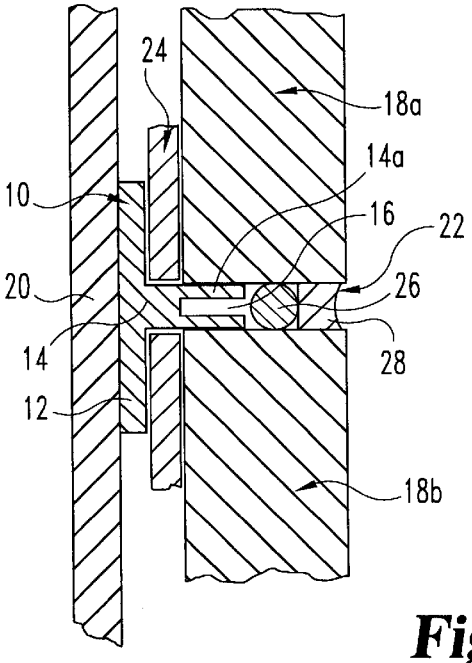
FIG. 3 is an enlarged cross-sectional view taken substantially along lines 3—3 of FIG. 2 showing the expansion joint guide, the underlying or support wall, an insulation layer, and the multi-course masonry wall as it is being constructed using the expansion joint guide.

The base 12 of the guide 10 is secured to the underlying wall 20 by any suitable means such as nails, screws or common construction adhesives such as those used to secure paneling to wallboards. In the illustration of FIG. 3, the base of the guide 10 is secured to the underlying wall 20 by means of adhesive, which is the preferred means of attachment.

The elongated planar leg 14 of the guide 10 extends perpendicularly from the base 12 and thus forms a locator for the ends of the masonry blocks which form the two sections 18*a* and 18*b* of the masonry block wall on either side of the joint, and thus the leg 14 forms a portion of the expansion joint 22 between these sections of the wall. The leg 14 is of a thickness equal to the desired thickness of the spacing between the adjacent blocks of the sections 18*a* and 18*b* so that the blocks forming these sections can abut the leg 14 of the guide 10 as shown in FIG. 3.

The outward extension of the leg 14 perpendicularly from the base 12 is less than the thickness of the blocks (front to back) of the wall being constructed and thus is less than the thickness of the wall 18 and of the sections 18*a* and 18*b* of the wall. The outer or distal end 14*a* of the leg preferably has a longitudinal slot 16 as previously described in the area of contact with the masonry blocks of the wall sections 18*a* and 18*b* in order to provide a degree of resilience at the end in an otherwise rigid leg.

In the structure shown in FIG. 3, the leg 14 of the guide 10 extends from the base 12 of the guide through a layer of insulation 24 and into the spacing between the blocks forming the sections 18*a* and 18*b* of the wall. The perpendicular extension of the leg 14 from the base 12 is preferably substantially less than the thickness of the blocks of the wall being constructed because it is desired to finish off the expansion joint with a backer rod 26 and a joint filler such as caulking, resilient sealant or mortar 28. By being substantially less than the thickness of the blocks of the wall being constructed the perpendicular extension of the leg 14 permits a joint filler to be placed on top or the leg of the guide 10. The backer rod is used merely as a spacer so that the amount of caulking or mortar required to fill the void in the expansion joint area is reduced. The mortar, resilient sealant or caulking provides the desired aesthetic weatherproofing or other functional effect for the joint.

The exact dimensions of the guide 10 will depend upon the type of masonry block which is used. In a brick wall construction, for example, it is preferred that the base 12 of the guide have a width of about four inches and a thickness of about one-eight inch. Since the joint is preferred to be about three-eights of an inch wide, the leg 14 of the guide will have a thickness of approximately three-eights of an inch, and the perpendicular extension of the leg outwardly from the base is preferably approximately two inches from the back surface of the base, that is, the surface which is secured to the underlying support wall. The slot 16 is preferably one-eight of an inch wide leaving one-eight inch of material on either side and the slot is preferably approximately three-quarters of an inch deep which is the extension of the leg 14 in between the blocks of the wall sections 18*a* and 18*b*.

If the guide is to be used in connection with concrete blocks or stone, then the dimensions may change, although it is believed that a standard guide useable with brick walls may also be useable with stone and concrete block walls as well. If the thickness of the concrete blocks or stones which are used in the wall is greater than that of a brick, additional backing rods or fillers may have to be used in order to minimize the amount of joint filler, i.e., caulking, resilient sealant or mortar, which is used to finish the expansion joint.

The material from which the guide 10 is constructed may be any number of different types of plastic or even possibly of metal. However, it is preferred that it be of a plastic which can be easily extruded and which will provide sufficient rigidity so that the leg 14 of the guide will act as a locator for the ends masonry elements, i.e., bricks, concrete blocks or stones, which form the adjacent sections 18*a* and 18*b* of the masonry block wall.

It is also possible that the slot 16 could be eliminated or made substantially deeper so that it would encompass the entire length of the leg which extends between the blocks forming the sections 18*a* and 18*b* of the masonry block wall. This would not be preferred, however because the leg 14 should have sufficient resilience in the joint to allow for expansion and contraction. The slot 16 could also be filled with a resilient material, and in certain circumstances the slot may be eliminated entirely so that the leg is solid throughout its perpendicular extension, though this is not preferred. The length of the guide 10 is preferably the height of the wall being constructed or just slightly less so that a single guide may be used to form each expansion joint of the wall. It is possible, however, to use several guides in end-to-end relationship particularly if the guides are secured to an underlying wall although only one is shown. It may be desirable to have several joints in the wall, and it is recommended that such a vertical joint be provided in the wall at every 20 feet.

Other variations of the invention may become apparent to those skilled in the art and may be utilized without departing from the scope of the invention as hereinafter claimed.

What is claimed is:

1. A process for the construction of multi-course masonry wall having a vertical expansion joint between adjacent sections of the wall, said wall covering a previously constructed underlying wall, said process comprising the steps of:

(a) providing a guide having an elongated flat planar base and an elongated planar leg, the width of said leg being less than the thickness of the wall to be constructed and the thickness of said leg being the desired thickness of the joint between laterally adjacent blocks of the wall being constructed;

(b) securing said base of said guide to said previously constructed underlying wall with the leg of said guide extending vertically and located at the desired position of the vertical expansion joint between adjacent sections of the wall being constructed; and (c) completing the construction of the masonry wall using the leg of said guide to position the edges of the masonry blocks to define the vertical expansion joint between adjacent sections of the wall.

2. The process of claim 1 wherein said guide is constructed of a rigid material.

3. The process of claim 2 wherein said material is plastic and said guide is extruded.

4. The process of claim 2 wherein said guide is longitudinally slotted to provide transverse resilience.

5. A system for aligning masonry blocks in a multi-course masonry block wall during construction, comprising:

a) a previous constructed underlying wall;

b) a horizontal elongated flat planar base of a rigid material secured to said underlying wall;

c) an elongated planar leg extending vertically from said planar base wherein said planar leg has a thickness which is the desired thickness of the joint between laterally adjacent blocks of the wall, and;

d) a plurality of masonry blocks abutting said planar leg said blocks having a thickness defining a wall thickness;

e) wherein said planar leg has a width less than said wall thickness.

6. A system of claim 5 wherein said planar leg defines a vertical joint between sections of the wall to be constructed.

7. A system of claim 6 wherein said leg is longitudinally slotted to provide transverse resilience.

8. A system of claim 7 wherein said guide is plastic.

* * * * *